US006053631A

United States Patent [19]

Mock et al.

[11] Patent Number: 6,053,631

[45] **Date of Patent: *Apr. 25, 2000**

[54] PLASTIC CASE WITH A SUPPORT BODY FOR AN ELECTRONIC DEVICE

[75] Inventors: Elmar Mock, Biel; Mathias Hell, Bern, both of Switzerland

[73] Assignee: Createc Patent Holding S.A., Luxembourg

[ * ] Notice: This patent issued on a continued prosecution application filed under 37 CFR 1.53(d), and is subject to the twenty year patent term provisions of 35 U.S.C. 154(a)(2).

[21] Appl. No.: 09/060,506

[22] Filed: Apr. 15, 1998

Related U.S. Application Data

[63] Continuation of application No. 08/436,266, Jun. 7, 1995, abandoned.

[30] Foreign Application Priority Data

Nov. 19, 1992 [CH] Switzerland ..... 3548/92

[51] Int. Cl.[7] ..... G04B 37/00

[52] U.S. Cl. ..... 368/281; 368/294; 368/295; 368/309

[58] Field of Search ..... 368/294–296, 368/314, 297, 281, 282, 309

[56] References Cited

U.S. PATENT DOCUMENTS

| | | | |
|---|---|---|---|
| 2,562,607 | 7/1951 | Ford | 58/105 |
| 3,473,319 | 10/1969 | Glass | 58/91 |
| 3,789,606 | 2/1974 | Isono | 58/90 R |
| 4,522,508 | 6/1985 | Meister | 368/276 |
| 4,561,783 | 12/1985 | Lederrey | 368/309 |
| 4,993,007 | 2/1991 | Meister | 368/294 |
| 4,999,823 | 3/1991 | Grosjean | 368/295 |
| 5,321,670 | 6/1994 | Rebeaud et al. | 368/291 |

FOREIGN PATENT DOCUMENTS

| | | |
|---|---|---|
| 101 663 | 2/1984 | European Pat. Off. . |
| 150 746 | 8/1985 | European Pat. Off. . |
| 284 899 | 10/1988 | European Pat. Off. . |
| 2 254 814 | 7/1975 | France . |
| 2 561 795 | 9/1985 | France . |
| 2 579 781 | 10/1986 | France . |
| 1 829 900 | 4/1961 | Germany . |
| 338 404 | 7/1959 | Switzerland . |
| 666 378 | 7/1988 | Switzerland . |

*Primary Examiner*—Bernard Roskoski
*Attorney, Agent, or Firm*—Walter C. Farley

[57] ABSTRACT

A plastic case for an electronic device such as a wrist or pocket watch, has a bottom (1), a cover glass (2) and a support body (3), as well as a dial (6). The support body (3) serves as a base for the dial (6). The bottom (1) and cover glass (2) are fixed to the support body (3) by means of irreversible connections (7, 8). The irreversible connections have first self-locating structures (7) for irreversibly attaching the bottom (1) to a lower portion of the support body (3), and second self-locating structures (8) for irreversibly attaching the cover glass (2) to an upper portion of the support body (3) so that the support body (3) lies between the cover glass (2) and the bottom (1). The support body (3) can have attachments (12) for fitting holders such as a bracelet or chain or holders can be formed on the support body (3).

12 Claims, 6 Drawing Sheets

FIG. 13
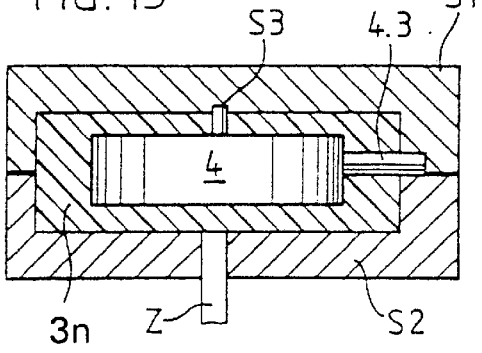
FIG. 14
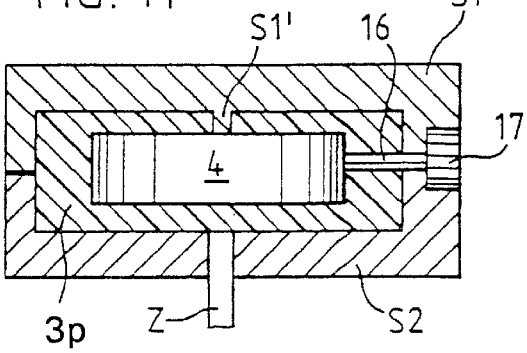
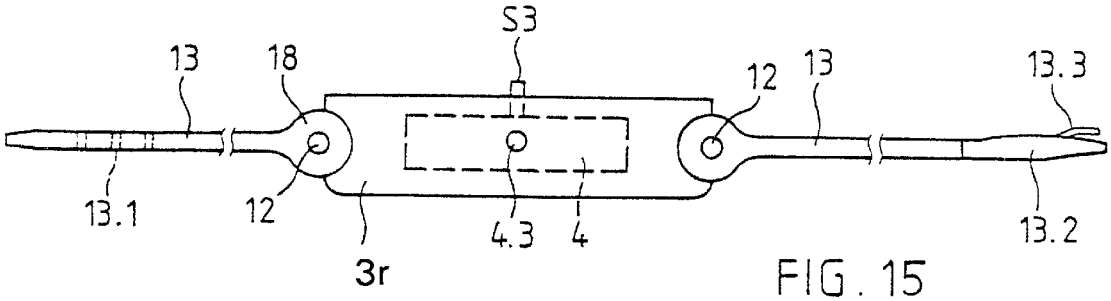
FIG. 15
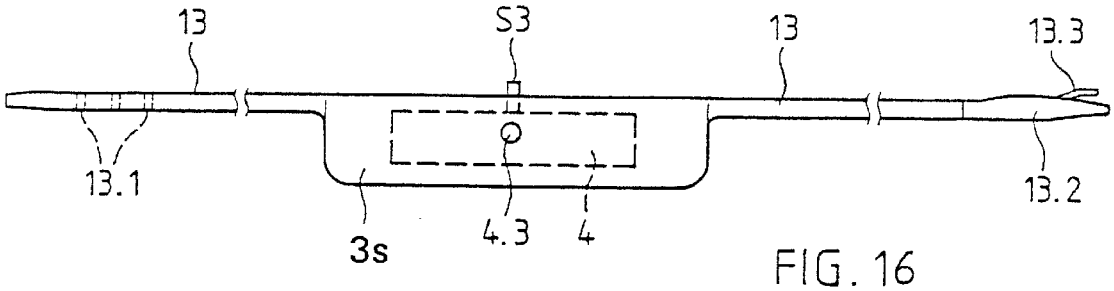
FIG. 16

PLASTIC CASE WITH A SUPPORT BODY FOR AN ELECTRONIC DEVICE

This is a continuation of Ser. No. 08/436,266 filed Jun. 7, 1995, now abandoned.

FIELD OF THE INVENTION

This invention relates to a plastic case for an electronic device such as a watch, a pager, an altimeter or the like, and more specifically to a plastic case for a wrist or pocket watch.

BACKGROUND OF THE INVENTION

Wrist or pocket watches normally have a watch case formed from a bottom part and a cover glass and having a firm connection. The bottom receives a movement which drives hands, and the cover glass makes it possible to see the time information. The time information is provided by the hands and a dial positioned between the movement and the hands. The hands and dial form the time indicating elements. By means of bracelets or chains the wrist or pocket watches are held. The connection takes place by means of a fastener fitted to the watch case.

Such wrist or pocket watches are characterized by a large number of different constructional features, so as to meet varying demands and needs of the consumer and also take account of different and rapidly changing manufacturing methods. Embodiments of such wrist watches are disclosed in U.S. Pat. No. 3,473,319, U.S. Pat. No. 3,789,606, FR-2, 254,814, EP-150,746, DE-1,829,990 and FR-2,561,795. Such wrist or pocket watches are designed in such a way that each of the individual components mainly fulfils a single function. The bottom receives the movement and the cover glass permits the viewing of the time information, etc. Therefore a certain minimum number of components is required for the construction of the watch, which must be precisely matched to one another, so that e.g. the artistic design, namely the variation of certain shapes and materials of the individual components and therefore their appearance (shape and decoration) is necessarily restricted.

Moreover, the watches according to the state of the art cannot be manufactured at low cost, rapidly and automatically. They are often made of materials which are expensive and difficult to process, and their various parts are attached to each other by complicated means such as screws. Not all of the watches according to the state of the art are waterproof, especially those assembled by locking engagement or clamping.

It is now looked upon as a disadvantage if individual components of a case are difficult to replace. This more particularly applies with respect to the nature of the connecting elements and the choice of the materials used. Particularly in the case of low-priced watches, which are manufactured in large numbers and create fashion phenomena or must rapidly follow function, a rapid modification of the products must be ensured.

SUMMARY OF THE INVENTION

An object of the invention is to provide a low-price case structure for an electronic device such as a wrist or pocket watch without the foregoing disadvantages. The case should be manufactured rapidly, automatically and reliably. A further aim is to permit greater design freedom in the shaping and decorating of the case. The simplifications of manufacture and consequently cost reductions in the manufacturing process, together with increased design freedom, gives such a case a considerably improved marketability or competitiveness. It is also advantageous if the individual components of the case can be easily interchanged and replaced for assembly purposes, so that the modification or changing of a component of the case leads to its appearance (shape and decoration) being changed.

This object is achieved by a case structure comprising a bottom, a display cover (e.g., a cover glass), a generally annular support body, a base for a displaying means (e.g., a dial), first self-locating means for irreversibly attaching the bottom to a lower portion of the support body, and second self-locating means for irreversibly attaching the display cover to an upper portion of the support body so that the support body lies between the display cover and the bottom. Thus, between the bottom and the display cover are inserted one or more connecting elements, which lead to the formation of a support body. The bottom on the one hand and the display cover on the other are irreversibly attached to said support body. Therefore, the support body serves as a base for the bottom, the display cover and a displaying means. It can be in one piece with the base for the displaying means. A support element, i.e., a wristband, bracelet or chain can also be attached to the support body or, alternatively, to the bottom or the display cover. An electronic module (e.g., a watch movement) can be supported by the base for the displaying means.

In order to make possible rapid, automatic and reliable manufacturing of low-priced cases, the bottom, display cover, support body and base for the displaying means are injection molded of weldable plastic material. The surfaces of the components to be assembled are given special shapes. These special shapes are realized by self-locating or self-centering means on the components. In the assembling process, the support body has a leading function. The bottom, the display cover and possibly the base for the displaying means are put on the support body, and are aligned with respect to each other by the self-locating means. Then they are irreversibly attached to each other, e.g., by welding and/or gluing, during which pressure is applied to the components. The self-locating means are parts of the attachments, e.g., of the welding or gluing surfaces.

The self-locating means have a plurality of functions. Before the assembly of the components, they serve for aligning the components with respect to each other. They also have a coding or "lock-and-key" function in order to prevent assembling components which do not belong together, thus increasing the reliability of the manufacturing process. During the assembly of the components, the self-locating means act as anchoring means in order to prevent dislocations of the components. After the assembly, the self-locating means act as parts of the attachments; they hold the components together and make the attachments even more stable. According to a simple embodiment of the invention, the self-locating means are parts of spherical surfaces. According to another embodiment, the self-locating means are ridges and grooves on the surfaces of the elements. According to an even more sophisticated embodiment, the self-locating means are coded ridges, grooves, pins, holes etc., as known from a lock and a key.

An advantage of the invention is the possibility of using a plurality of different connecting elements for forming a support body according to the invention, giving a considerable stimulus to the artistic design of the case. The use of a plurality of different connecting elements, which in their function as a support body simultaneously have a structural or design function, changes the appearance of the case. As a result there is no need to modify or adapt other components of the case, such as the bottom and the display cover. Therefore the manufacturing costs of this novel case can be kept low. The assembly of such novel watches takes place according to the modular principle.

A further advantage of the invention is increased reliability of the automatic manufacturing process for low-priced plastic cases. This is achieved by the self-locating means on the case components according to the invention.

A further advantage of the invention is the possibility of directly incorporating the support body according to the invention into the case manufacturing process. When using the injection molding process the support body is itself used as the injection mold for other components of the case, such as the bottom or display cover. Therefore, when modifying the support body, other case components fitted thereto such as the bottom and display cover virtually automatically take part in said changes, which permits frequent variations with respect to the shape and decoration of the support body.

A still further advantage of the invention is the possibility of transferring to the support body according to the invention the functions of other case components, therefore reducing the manufacturing costs due to the reduction in the number of case components. For example, the support body can be applied by injection molding to an electronic module (e.g., a watch movement) and can therefore take over the functions of the bottom, fastener and base for a displaying means. Thus, in the support body there is a concentration of the watch functions leading to a large number of different support body embodiments.

Particular stress must be placed on the possibility of using differently shaped support bodies, which allow the fitting of three-dimensional decorations and the creation of profiles on the outer lateral faces of the support body. It is also possible to fit optical patterns, artistic representations and coloring effects, while polarized or colored material can be used. It is also possible to use transparent support bodies. These support bodies according to the invention can be made from the most varied materials, which can also be employed for other components of the case, such as for the display cover, the bottom or the base for the displaying means. Various irreversible connecting methods can be used, enabling the support body to be attached to other case components. Particular reference is made to irreversible connecting methods such as welding, molding, bonding or gluing.

In a preferred embodiment of the invention, the base for the displaying means is connected in one piece with the support body, which simultaneously embraces the electronic module fitted to the base for the displaying means. When using a transparent support body the display cover and support body are scarcely, or are not, distinguishable and the display cover is so peak extended and a region representing the base for the displaying means is optically separated. This leads to a particular effect, namely when considering the wrist or pocket watch through the cover glass in the usual way e.g. for establishing the time, the thus extended cover glass extends down over the dial plane to the bottom, while the actual movement is covered by the dial. In this way the watch is given a particularly esthetic and unusual appearance, such as is e.g. described in Swiss Patent 657, 246.

Thus, new freedoms are offered with respect to the artistic design of the watch with the aim of creating largely individualized electronic devices by the use of a plurality of different support bodies according to the invention. By incorporating the support body into the construction of the case the manufacturing process is simplified, because the design expression of the case occurs in the widely varying shaping of the support body according to the invention and consequently the connecting elements and it is now possible for both the bottom and the display cover to use standardized components with correspondingly standardized connections. The above-described, advantageous construction of the support body according to the invention has one or more connecting elements and therefore has a firm connection with the bottom, as well as a firm connection with the display cover and, by means of the fastener, a firm connection to the wristband, bracelet or chain. Moreover, the base for the displaying means is integrated into the support body according to the invention and once again the electronic module is held by said base for the displaying means. This represents a considerable innovation compared with conventional cases. As a result of the concentration of the functions in the support body according to the invention, or the one or more connecting elements, the manufacturing process is simplified. The main function of the bottom and display cover is to seal the case and display information, which can be inexpensively implemented by the extensive use of standardized components. The concentration of functions in the support body can be further increased by said support body e.g. taking over the functions of the bottom and the display cover.

BRIEF DESCRIPTION OF THE DRAWINGS

The invention is described in greater detail hereinafter relative to various embodiments and the attached figures. The embodiments described refer to watch cases; however, the case according to the invention can also be used for other electronic devices such as pagers, altimeters and the like.

FIGS. 13 and 14 are longitudinal sections through parts of eleventh and twelfth embodiments of a support body according to the invention, respectively.

FIGS. 15 and 16 are longitudinal sections through parts of thirteenth and fourteenth embodiments according to the invention, respectively.

DESCRIPTION OF THE PREFERRED EMBODIMENTS

Figure 1:
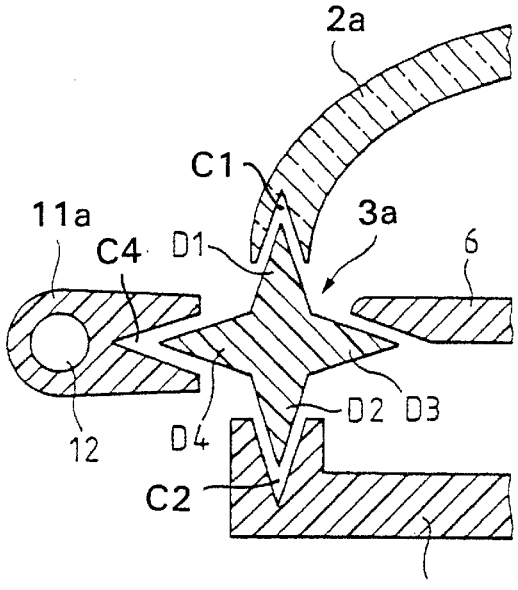
FIGS. 1–6 are longitudinal sections through parts of six embodiments of support bodies according to the invention.

FIG. 1 is a longitudinal section through part of a first embodiment of a watch according to the invention. This embodiment comprises a generally annular support body 3*a* with a star- or cross-shaped radial section with four tapering connecting elements or arms D1, D2, D3 and D4. To the surface of arm D1 is connected a cover glass 2*a*, to arm D2 is connected a bottom 1*a*, and to arm D3 is connected a dial 6*a*. Arm D4 is connected to a fastener 11*a* with a circular passage 12 to receive a connection for holding means such as a bracelet or chain. The connections of the support body 3*a* with cover glass 2*a* and bottom 1*a* are made with known irreversible watch connecting methods, such as e.g. ultrasonic welding or gluing. Together with corresponding, mating grooves C1 and C2, connecting elements D1 and D2 form self-locating means. Thus, arm D1 mates with groove C1 of cover glass 2*a*. Arm D2 mates with groove C2 of bottom 1*a*. Connecting element D3 has a step for fitting a positive plug or adhesive-bonded joint with dial 6*a*. Arm D4 mates with a groove C4 of fastener 11*a*. The support body according to the invention has no fixed, prescribed basic shape. What is decisive is that the support body has a sufficiently large volume to enable it to be worked with standard watch means in order to fit the above-described connections.

Figure 2:
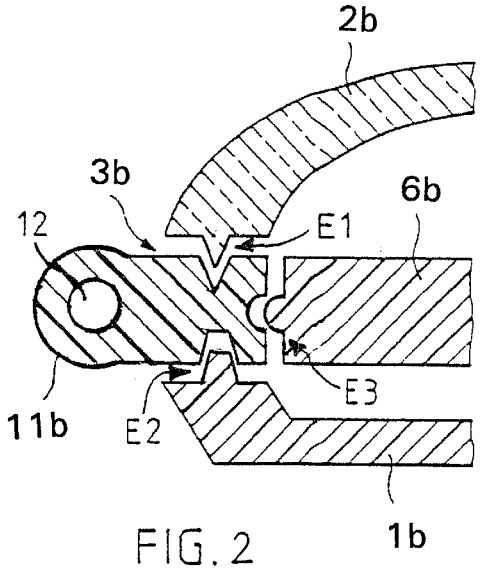

FIG. 2 shows a second embodiment of a support body 3*b* according to the invention with a square radial section and self-locating means E1 and E2. The function and working of self-locating means E1 and E2 correspond to those of self-locating means D1 and D2 described relative to FIG. 1. The self-locating means E1 forms a welded or an adhesive-bonded joint between support body 3*b* and cover glass 2*b*. The self-locating means E2 forms a welded or an adhesive-bonded joint between support body 3*b* and bottom 1*b*. It should be noted that self-locating means E1 has a shape different from that of self-locating means E2. Thus, self-locating means E1 and E2 have also a coding function. Bottom 1 cannot be attached to the upper portion of support body 3*b*, nor can cover glass 2*b* be attached to the lower portion of the support body. Connecting means E3 forms a welded, an adhesive-bonded or a plug joint or connection between support body 3*b* and dial 6*b*. In this embodiment, fastener 11*b* is in one piece with support body 3*b*. Fastener 11*b* once again has a circular passage 12 for fitting a connection with holding means such as a bracelet or chain.

Figure 3:
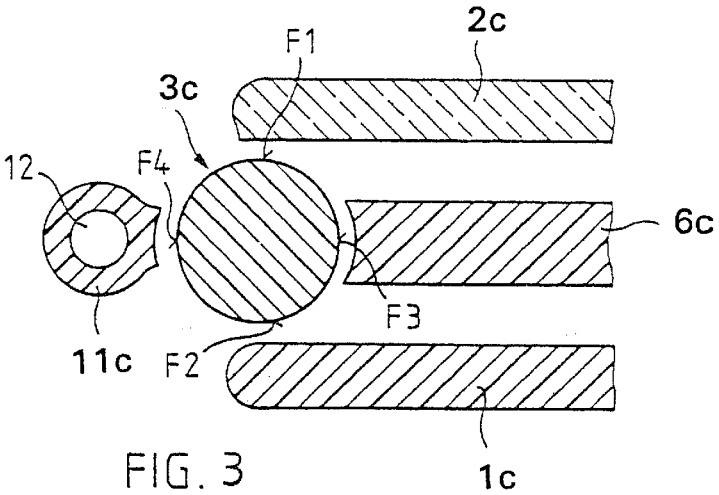

FIG. 3 shows a third embodiment of a support body 3*c* according to the invention with a circular radial section. It is a further development of the arbitrarily shaped support body according to the invention. In this embodiment, support body 3*c* is a torus, whose surface has convex surface areas F1, F2, F3 and F4. The function and working of the four convex surface areas F1, F2 and F3 correspond to those of the four planar connecting faces E1, E2 and E3 described relative to FIG. 2. Surface area F1 forms an adhesive-bonded joint with a corresponding connecting face of cover glass 2*c*. Surface area F2 forms an adhesive-bonded joint with a corresponding connecting face of bottom 1*c*. Connecting face F3 forms an adhesive-bonded or plug joint with a corresponding connecting face of dial 6. Surface area F4 forms an adhesive-bonded joint with a corresponding connecting face of the fastener 11*c*. Fastener 11*c* again has a circular passage 12 for fitting a connection with holding means such as a bracelet or chain.

Figure 4:
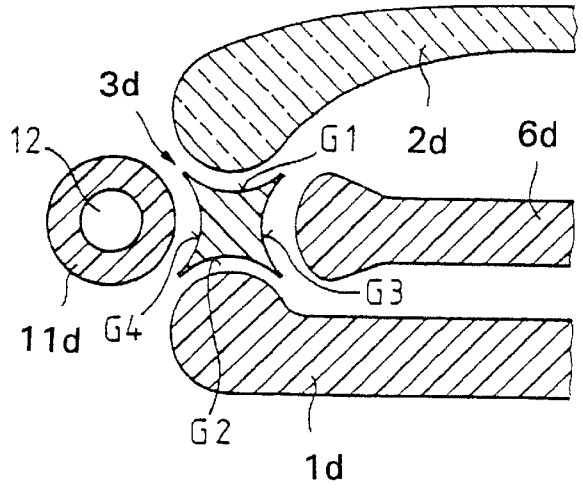

FIG. 4 shows in longitudinal section a fourth embodiment of a support body 3*d* according to the invention. The surface of support body 3*d* has four concave surface areas G1, G2, G3 and G4. The function and working of the four surface areas G1, G2, G3 and G4 correspond to those of the four convex surface areas F1, F2, F3 and F4 described relative to FIG. 3. Surface area G1 forms an adhesive-bonded joint with a corresponding, convex connecting face of cover glass 2*d*. Surface area G2 forms a corresponding adhesive-bonded joint with a convex connecting face of bottom 1*d*. Surface area G3 forms an adhesive-bonded or plug joint with a corresponding, convex connecting face of dial 6*d*. Surface area G4 forms an adhesive-bonded joint with a corresponding, convex connecting face of fastener 11*d*. This fastener 11*d* once again has a circular passage 12 for fitting a connection with holding means such as a bracelet or chain.

Figure 5:
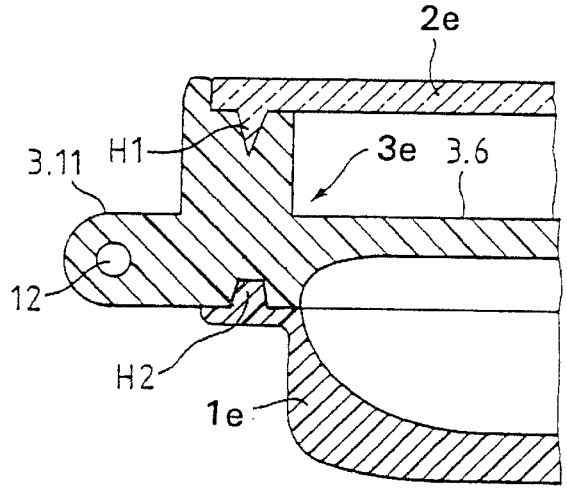

FIG. 5 shows in an asymmetrical longitudinal section a fifth embodiment of a support body according to the invention. Bottom 1*e* and cover glass 2*e* are attached to support body 3*e* by self-locating means H2 and H1, respectively. In the area 3.11, support body 3*e* fulfils the function of fasteners 11*a–d* of FIGS. 1 to 4. In the area 3.6, the support body also fulfils the function of the dial 3.6. It also has a circular passage 12 for fitting a connection with holding means such as a bracelet or chain. Thus, support body 3*e* according to the invention not only permits the connections between individual components of the watch, but even takes over functions of the watch components by shaping them onto one another.

Figure 6:
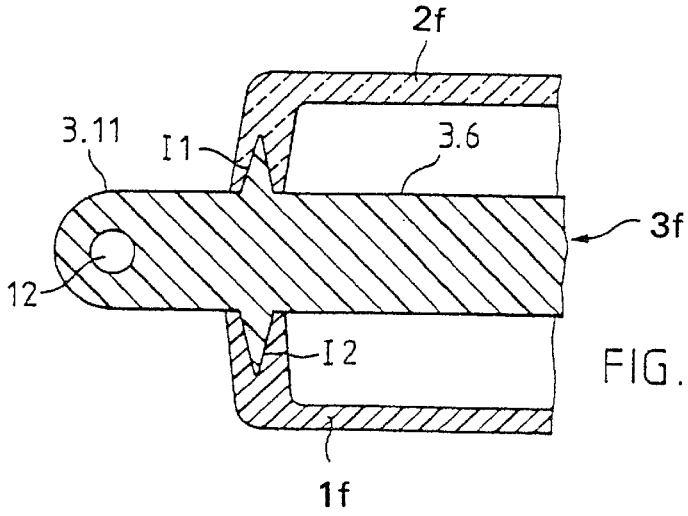

FIG. 6 shows a sixth embodiment of a support body 3*f* according to the invention in longitudinal section. As a result of different connecting methods with other components of the wrist or pocket watch, the outer surface of support body 3*f* is differently worked in areas of the two connecting, elements or self-locating means I1 and I2. The connecting element I1 has a welding lip for welding a welding groove of a cover glass 2*f*. The connecting element I2 has a welding lip for welding a welding groove of a bottom 1*f*. In the area 3.11, the support body 3*f* according to the invention also takes over the functions of the fastener 11*a–d* from FIGS. 1 to 4 and has a circular passage 12 for fitting a connection with holding means such as a bracelet or chain. In the area 3.6, the support body 3*f* also takes over the function of the dial 6*a–d* and has a dial surface. Support body 3*f*, fastener 11 and dial 6 are shaped or molded onto one another. As in the fifth embodiment of support body 3*e* according to the invention, the present sixth embodiment has a high concentration of watch component functions in body 3*f*.

Figure 7:
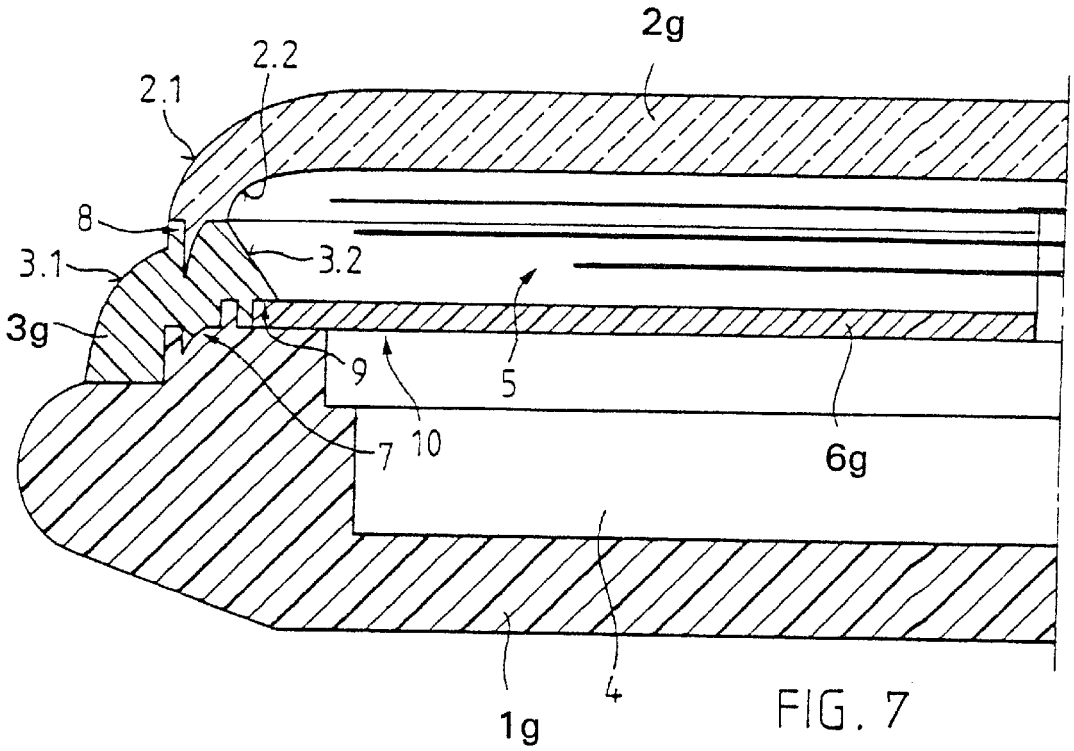
FIGS. 7 and 8 are longitudinal sections through part of a seventh embodiment of a support body according to the invention along the positions from 3 o'clock to 9 o'clock and from 6 o'clock to 12 o'clock, respectively, on the dial.

FIG. 7 is a longitudinal section through part of a wrist or pocket watch with a seventh embodiment of a support body 3*g* according to the invention, the section being along the position from 3 o'clock to 9 o'clock on the dial. This embodiment of support body 3*g* is characterized in that the bottom 1*g* and the cover glass 2*g* are fixed to body 3*g* by self-locating means 7, 8. For the better understanding of the invention the watch is schematically shown in greatly simplified form. The watch case comprises a bottom 1*g*, a cover glass 2*g* and the support body 3*g*. Bottom 1*g* is fixed to support body 3*g* by means of the bottom/support body connection 7 and convex cover glass 2*g* is fixed to support body 3*g* by means of the cover glass/support body connection 8. The connections 7, 8 also have a sealing function and can comprise standard watch connecting means, such as e.g. ultrasonic welding and bonding. In the embodiment of FIG. 7, preference is given to such welded joints. On support body 3*g* are provided closed, all-around, circular welding grooves for producing the connections 7, 8. Dial 6*g* is retained all around by support body 3*g* using dial/support body connection 9. Movement 4, which is not shown in section, is supported and held all around by dial 6*g* by movement/dial connection 10. Thus, support body 3*g* also serves as a base and support for movement 4. Connections 9 and 10 can be standard watch-type connections, e.g. clamping, bonding or welding connections.

The basic shape of the seventh embodiment of support body 3*g* is not fixed. At least one outer, lateral face 3.1 of support body 3*g* has a larger diameter than the outer, lateral face 2.1 of cover glass 2*g*. The outer, lateral face 3.1 therefore projects outwardly beyond outer lateral face 2.1 relative to hands 5. The inner, lateral face 3.2 of support body 3*g* has a smaller diameter than the inner, lateral face 2.2 of the cover glass 2*g*. Thus, the inner, lateral face 3.2 lies radially inwardly of inner, lateral face 2.2 of cover glass 2*g* relative to hands 5. The lateral extensions of support body 3*g* shown in FIG. 7 can be arbitrarily shaped and are not restricted by the dimensions of bottom 1*g* and cover glass 2*g*. Numerous possibilities are available to the expert for modified or supplementary constructions. By interchanging and modifying support body 3*g* according to the invention and while retaining the dimensions of all the other watch components, in a simple, rapid and inexpensive manner a pocket or wristwatch with a different appearance is created.

Figure 8:
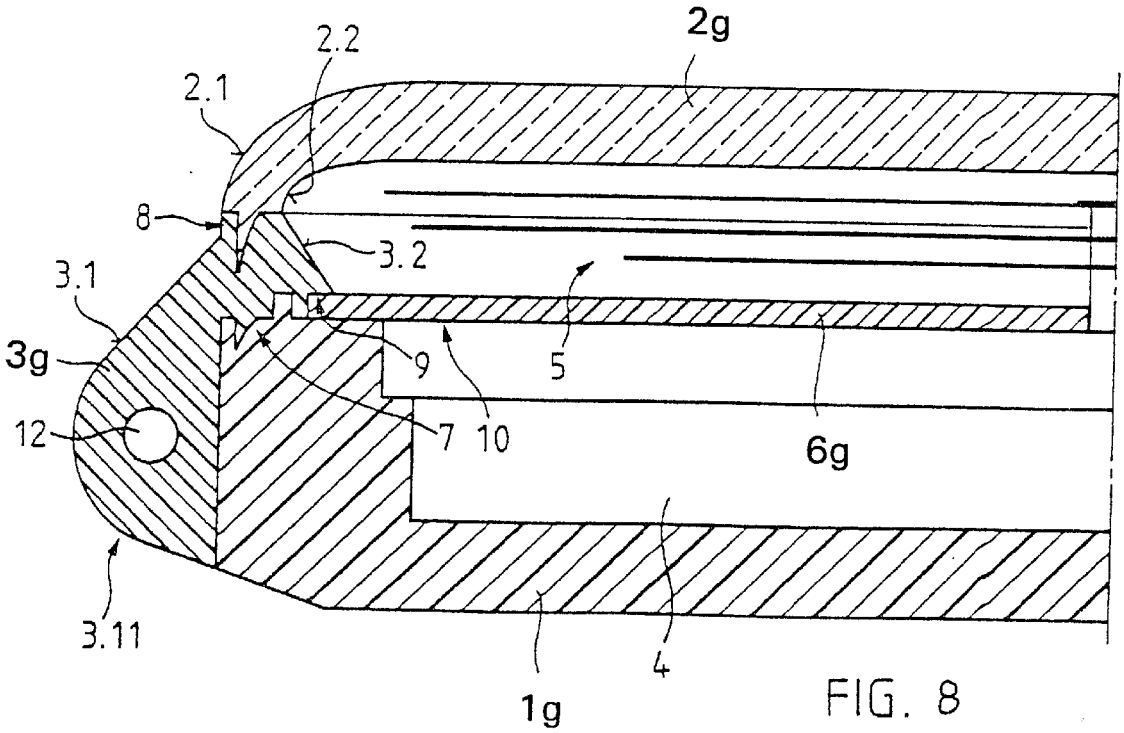

FIG. 8 is a longitudinal section through part of the pocket or wrist watch shown in FIG. 7 with the seventh embodiment of a support body 3*g* according to the invention along the position from 6 o'clock to 12 o'clock on the dial. In this view of the support body 3*g* according to the invention, in addition to the aforementioned remarks, it is stressed that the support body 3*g* takes over the functions of a fastener 3.11 with circular passages 12 for the fitting of holding means such as a bracelet or chain. This is brought about by support body 3*g* and fastener 11 being shaped or molded onto one another.

Support body 3*a–g* according to the invention can be made from a transparent plastics material, which can be similar to that used for the cover glass 2*a–g*, e.g., an acrylic resin or a polycarbonate compound.

The assembly of the wrist or pocket watch shown in FIGS. 7 and 8 with the seventh embodiment of a support body 3*g* according to the invention advantageously takes place beginning with a first step in which dial 6*g* is fitted in a positively held manner to movement 4 by movement/dial connection 10. Then, in a further step, the dial is retained by dial/support body connection 9. In a further step, bottom 1*g* is aligned relative to support body 3*g* by self-locating means and is irreversibly attached to support body 3*g* by bottom/support body connection 7. The last two steps can take place simultaneously. In further steps, hands 5 are mounted on movement 4. Then, cover glass 2*g* is aligned relative to support body 3 by self-locating means and is irreversibly attached to support body 3*g* by cover glass/support body connection 8. The whole manufacturing process can be carried out automatically.

Figure 9:
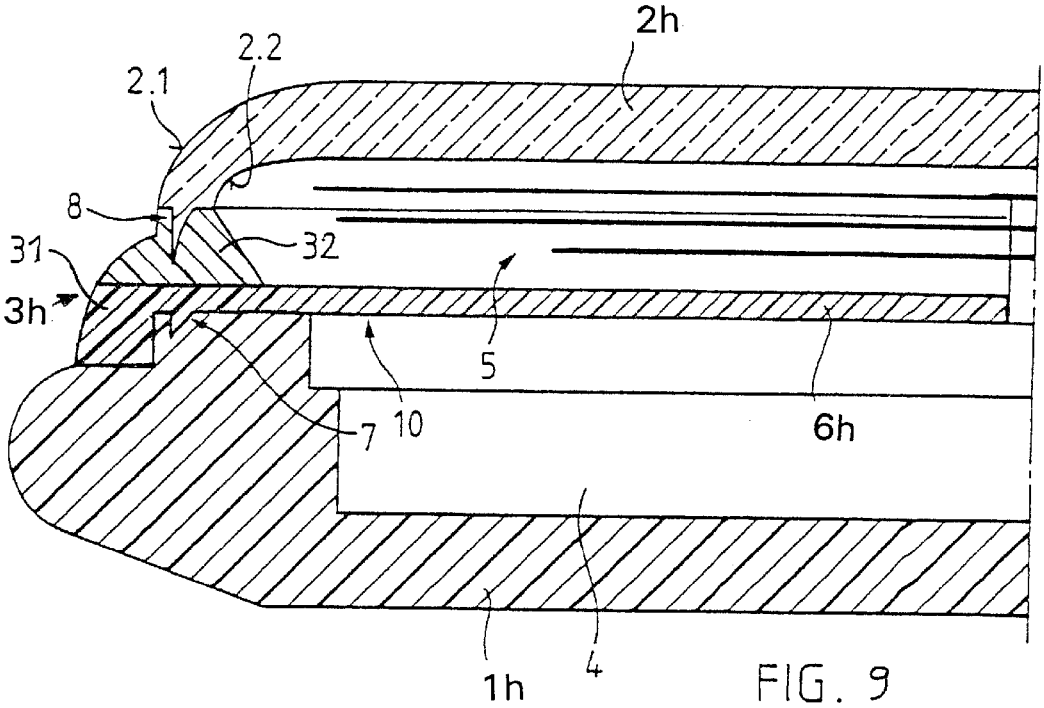
FIGS. 9 and 10 are longitudinal sections through part of an eighth embodiment of a support body according to the invention along the positions from 3 o'clock to 9 o'clock and from 6 o'clock to 12 o'clock, respectively, on the dial.
Figure 10:
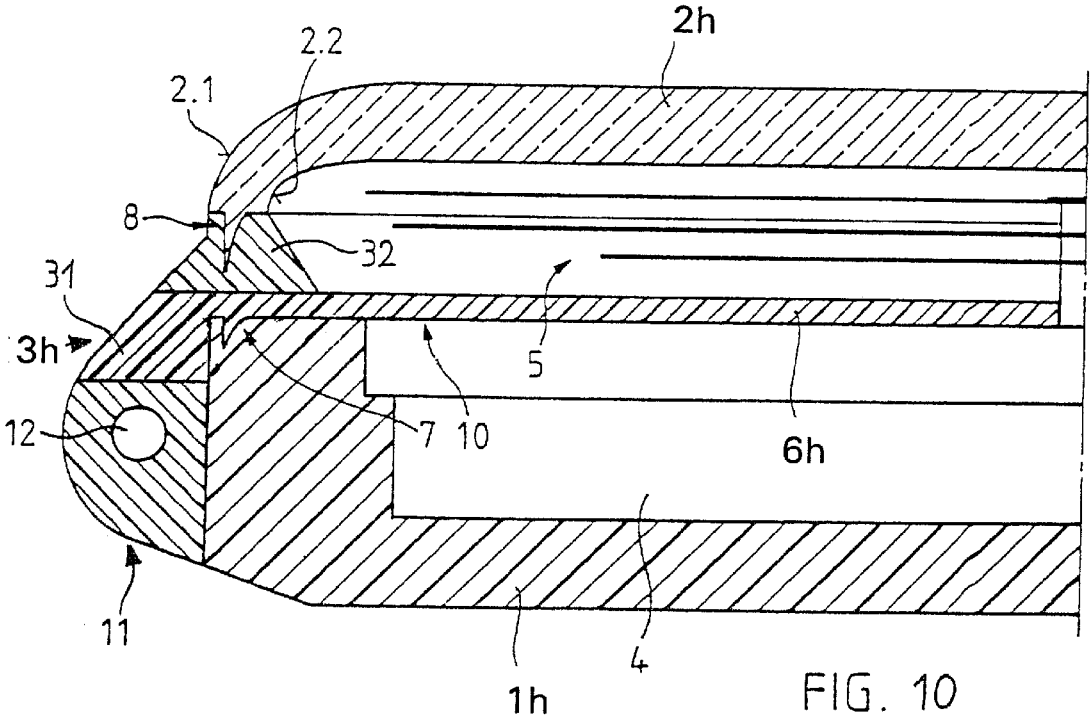

FIGS. 9 and 10 show an eighth embodiment of a watch according to the invention, in longitudinal sections analogous to those of FIGS. 7 and 8. This embodiment is similar to that of FIGS. 7 and 8, except for the following differences. Support body 3*h* consists of a first support-body part 31 and a second support body part 32, which can be, e.g., welded together. Second support-body part 32 may be provided for artistic purposes and essentially to influence the visual appearance of the watch. Dial 6*h* is made in one piece with first support body part 31. Fastener 11*h* is separate from support body 3*h*.

Figure 11:
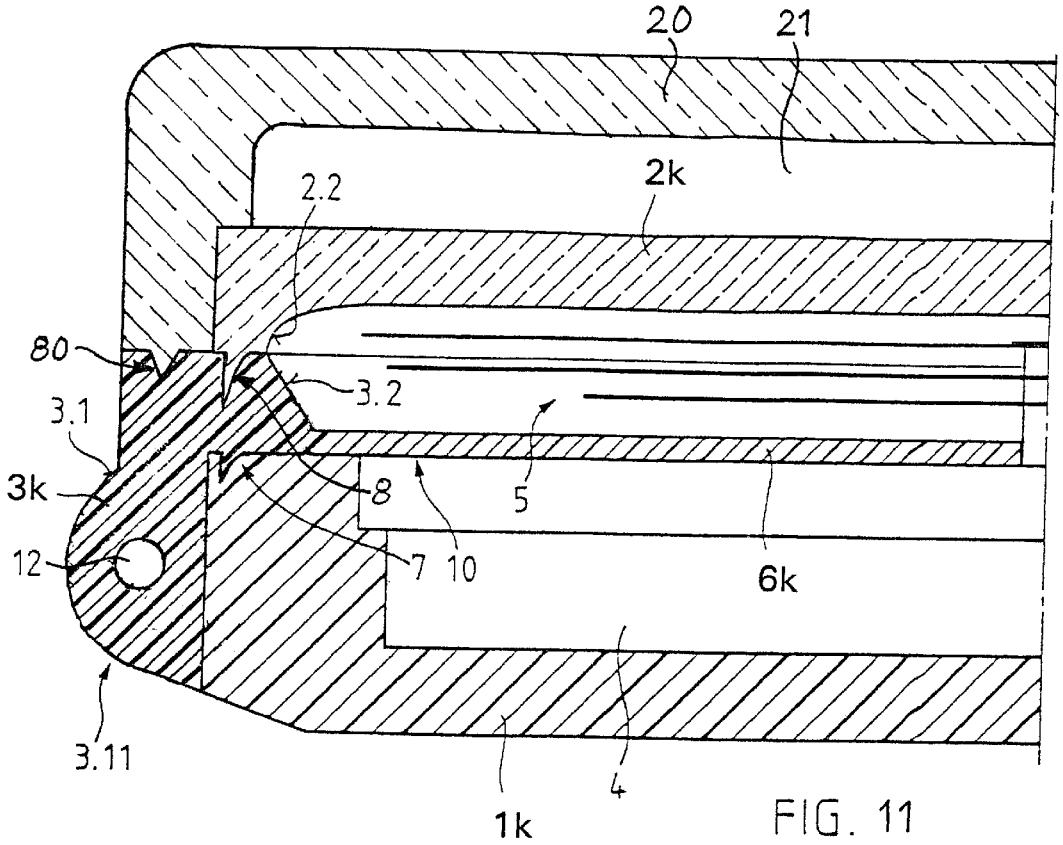
FIGS. 11 and 12 are longitudinal sections through parts of ninth and tenth embodiments of a support body according to the invention, respectively, along the position from 6 o'clock to 12 o'clock on the dial.
Figure 12:
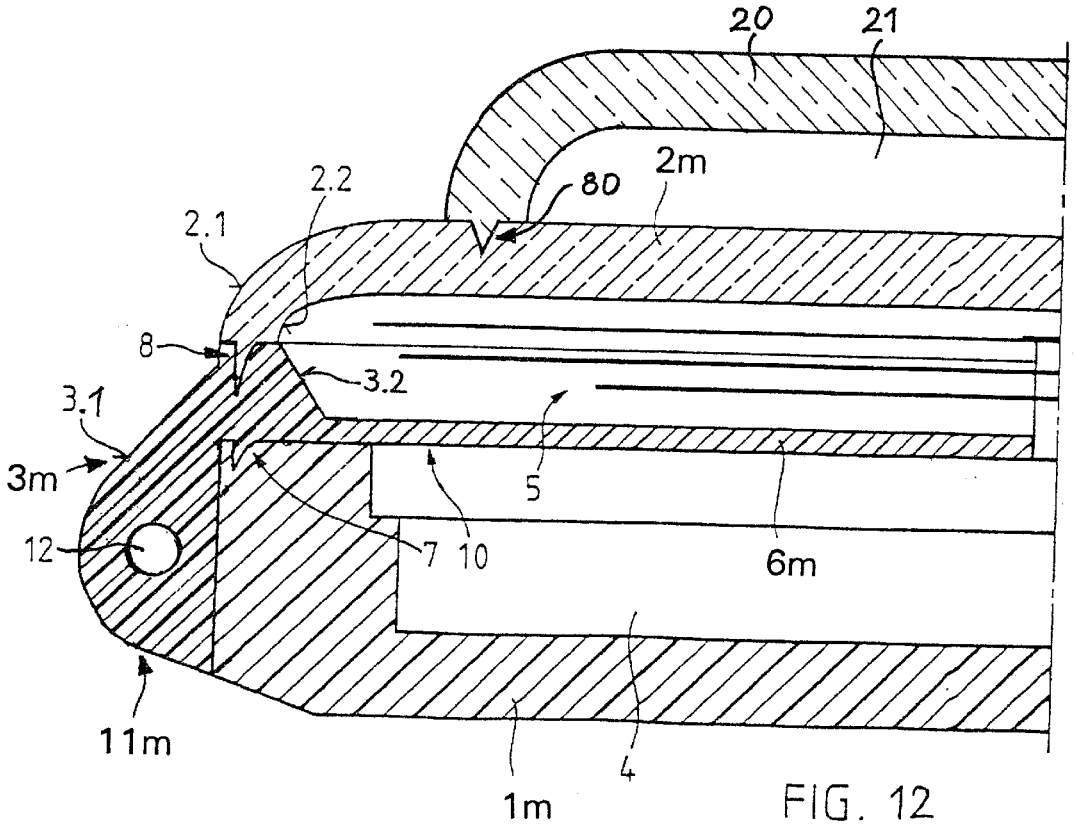

FIGS. 11 and 12 show ninth and tenth embodiments of a watch according to the invention, respectively, in longitudinal sections analogous to that of FIG. 8. These watches have a first cover glass 2*k* and a second cover glass 20, with a space 21 in between. Space 21 can be filled with a liquid for special visual effects, or can contain toys. In the embodiment of FIG. 11, cover glasses 2*k* and 20 are attached to support body 3 by self-locating means 8 and 80, respectively; the first cover glass 2*k* totally covers dial 6*k*, and second cover glass 20 totally covers first cover glass 2*k*. In the embodiment of FIG. 12, only first cover glass 2*m* is attached to support body 3*m* by self-locating means 8, and second cover glass 20 is attached to first cover glass 2*m* by self-locating means 80. Dial 6*m* is made in one piece with support body 3*m*, and fastener 3.11 is also made in one piece with support body 3*m*.

FIG. 13 shows a longitudinal section through part of an eleventh embodiment of a support body 3*n* according to the invention. It illustrates a possible process for producing a watch according to the invention in an injection molding method. It is assumed that there is a finished movement 4. In a first production step, the movement 4 is introduced into an injection molding means which has two sliders S1, S2. Prior to molding, movement 4 is provided with a molding sleeve S3 for the driving shafts of the hands and with a passage for a winding spindle, tube 4.3. Sliders S1, S2 firmly hold movement 4, e.g., over molding sleeve S3 and/or tube 4.3. The cavity formed by sliders S1, S2 is connected to an injection-molding-medium supply by a supply inlet Z. Plastic or another medium is injected into the cavity and support body 3*n* according to the invention is formed. Movement 4 is completely encased by support body 3*n*. Following the complete encasing of movement 4 in the cavity between the two sliders S1, S2, the two passages S3 and 4.3 project out of formed support body 3*n* and allow the fitting on the driving shaft of the hands, as well as the fitting of the winding spindle.

FIG. 14 is a longitudinal section through part of a twelfth embodiment of a support body 3*p* according to the invention. It is based on the embodiment of FIG. 13, but the differences are marked. Molding sleeve S3 is here part of slider S1 and is called the slider sleeve S1'. It can be arbitrarily shaped. In addition, this embodiment requires no passage for the winding-up spindle or tube 4.3 as in FIG. 13, because in FIG. 14 a winding-up spindle 16, together with the winding cap or winder 17 fitted thereon are molded during the injection molding process. The complete molded encasing of movement 4 consequently takes place in a cavity between the two sliders S1, S2, at the same time as slider sleeve S1' and winding spindle 16.

The support bodies 3*n* and 3*p* produced with the method described with respect to FIGS. 13 and 14 are preferably used for embodiments where the dial 6 is made in one piece with the support body 3, such as shown in FIGS. 9–12.

FIG. 15 is a longitudinal section through a part of a thirteenth embodiment of a support body 3*r* according to the invention. For the production of this embodiment, in a first step a movement 4 is introduced into an injection molding means and completely molded in by support body 3*r*. This process is described in FIG. 13. Prior to the molding, movement 4 is provided with a molding sleeve S3 for a winding spindle and tube 4.3. The support body formed by the injection molding process also has a passage 12 for fitting holding means such as a bracelet 13. In a further production step a bracelet 13 with holes 1.1 and a fastening 18 are injection molded. It can be made from a different plastics material. The bracelet fastening 18 is molded onto the passage 12 of the support body 3. In a further production step a clasp 13.2 and tongues 13.3 are injection molded. Here again a different and advantageously very hard plastic is used. The final steps of watch assembly, namely the attachment of the hands, the introduction of the winding spindle, the welding-on of the cover glass and the fitting of the winder are not shown, but take place in accordance with the prior art. This thirteenth embodiment of the support body 3*r* has a high concentration of watch functions, the support body 3*r* fulfilling the function of the bottom, dial, fastener and also retains the movement 4. The watch is produced in an injection-molding process in a few automated steps.

FIG. 16 is a longitudinal section through part of a fourteenth embodiment of a support body 3*s* according to the invention. It is a variant of the injection-molding-based watch production process explained in FIG. 15. For the production of this embodiment, in a single production step a movement 4 is fed into an injection-molding means and completely encased by support body 3*s*. Prior to molding, movement 4 is provided with a molding sleeve S3 for the driving shafts for the hands and with a passage for a winding spindle, tube 4.3. Support body 3*s* according to the invention formed in one working step by injection molding has an extremely high concentration of watch functions, said body taking over the functions of the bottom, dial and fastener, while retaining the movement. It thus constitutes the bracelet 13, having bracelet holes 13.1 and a clasp 13.2. The desired different hardnesses of support body 3*s* and bracelet 13 is brought about by using a multi-component injection-molding process, varyingly hard plastics components being injected. The final steps of watch assembly, namely the setting of the hands, the insertion of the winding spindle, the welding on of the cover glass and the fitting of the winder and the movable tongues 13.3 are not shown, but take place in accordance with the prior art.

Of course, combinations of the various embodiments shown in the figures are possible.

We claim:

1. A case for an electronic device comprising a bottom injection molded of weldable plastic material;

a display cover injection molded of weldable plastic material;

a generally annular support body injection molded of weldable plastic material;

a base for a displaying means injection molded of weldable plastic material;

first self-locating means for aligning said bottom with said support body and for irreversibly attaching said bottom to a lower portion of said support body; and second self-locating means for aligning said display cover with said support body and for irreversibly attaching said display cover to an upper portion of said support body so that said support body lies between said display cover and said bottom.

2. A case according to claim 1 and including means on said support body for clamping said base for a displaying means between said support body and said bottom.

3. A case according to claim 1 wherein said support body and said base for a displaying means are in one piece.

4. A case according to claim 1 wherein said first and/or second self-locating means are ridges and grooves matched to each other.

5. A case according to claim 1 wherein said bottom is irreversibly attached to said lower portion of said support body by welding or gluing, and said display cover is irreversibly attached to said upper portion of said support body by welding or gluing.

6. A case according to claim 1 and including means forming an attachment for a case support.

7. A case according to claim 6 wherein said case support comprises a wristband, bracelet or chain.

8. A case according to claim 1 wherein said support body is transparent.

9. A case according to claim 1 comprising a first and a second display cover with a space between said first display cover and said second display cover.

10. A case according to claim 1 wherein at least one lateral face of said support body protrudes radially beyond said at least one display cover.

11. An electronic device in a case, comprising a bottom injection molded of weldable plastic material;

a display cover injection molded of weldable plastic material;

a generally annular support body injection molded of weldable plastic material;

a base for a displaying means injection molded of weldable plastic material;

an electronic module supported by said base for a displaying means;

first self-locating means for irreversibly attaching said bottom to a lower portion of said support body; and second self-locating means for irreversibly attaching said display cover to an upper portion of said support body so that said support body lies between said display cover and said bottom.

12. An electronic device according to claim 11 wherein said electronic module is irreversibly attached to said base for a displaying means.

* * * * *